US008224010B2

(12) United States Patent
Cho et al.

(10) Patent No.: US 8,224,010 B2
(45) Date of Patent: Jul. 17, 2012

(54) SOUND REPRODUCTION APPARATUS FOR VARYING SOUND TRANSMISSION AND A CORRESPONDING METHOD THEREOF

(75) Inventors: Mei San Gigi Cho, Singapore (SG); Hwee Yong James Koh, Singapore (SG); Jason Goh, Singapore (SG)

(73) Assignee: Creative Technology Ltd, Singapore (SG)

( * ) Notice: Subject to any disclaimer, the term of this patent is extended or adjusted under 35 U.S.C. 154(b) by 569 days.

(21) Appl. No.: 12/419,245

(22) Filed: Apr. 6, 2009

(65) Prior Publication Data

US 2010/0254557 A1 Oct. 7, 2010

(51) Int. Cl.
*H04R 1/02* (2006.01)
*H04R 1/20* (2006.01)

(52) U.S. Cl. ..... 381/345

(58) Field of Classification Search ..... 381/345, 381/386, 387; 181/144, 148, 199
See application file for complete search history.

(56) References Cited

U.S. PATENT DOCUMENTS

| | | | | |
|---|---|---|---|---|
| 4,757,544 | A * | 7/1988 | Guy | 381/387 |
| 5,602,366 | A * | 2/1997 | Whelan et al. | 181/144 |
| 5,661,271 | A * | 8/1997 | Moser | 181/199 |
| 5,872,340 | A * | 2/1999 | Anagnos et al. | 181/199 |
| 6,005,642 | A * | 12/1999 | Meisner et al. | 348/838 |
| 6,891,957 | B2 | 5/2005 | Manrique et al. | |
| 7,535,799 | B2 * | 5/2009 | Polany et al. | 367/131 |
| RE41,384 | E * | 6/2010 | House | 381/386 |
| 7,796,775 | B2 * | 9/2010 | Oxford et al. | 381/386 |
| 7,804,966 | B2 * | 9/2010 | Adams et al. | 381/87 |
| 2008/0095395 | A1 * | 4/2008 | Pieklik et al. | 381/387 |
| 2010/0046786 | A1 * | 2/2010 | Zhen | 381/387 |

OTHER PUBLICATIONS

"Bamboo Stereo" by Soohyuk Im; URL: http://www.topblogposts.com/2008/01/bamboo-stereo-by-soohyuk-im/; Published on Feb. 17, 2008.

* cited by examiner

*Primary Examiner* — Jeffrey Donels
(74) *Attorney, Agent, or Firm* — Creative Technology Ltd

(57) ABSTRACT

There is provided an apparatus for sound reproduction which is able to vary transmission of sound. The apparatus includes a plurality of speaker casings, with each of the plurality of speaker casings including at least one speaker driver; and a plurality of bases for each of the plurality of speaker casings, with a top portion of each base being for securable placement of a foot of one of the plurality of speaker casings, and a bottom face of each base being for securable attachment to the bottom face of another of the plurality of bases. In a first configuration of the apparatus, the plurality of speaker casings is securely placed on the top portion of each of the plurality of bases, and independently rests on the bottom face of each base. In a second configuration of the apparatus, the plurality of speaker casings is securely placed on the top portion of each of the plurality of bases, and is attached to one another at the bottom face of each base. A corresponding method of using a sound reproduction apparatus for varying sound transmission is also provided.

9 Claims, 7 Drawing Sheets

SOUND REPRODUCTION APPARATUS FOR VARYING SOUND TRANSMISSION AND A CORRESPONDING METHOD THEREOF

FIELD OF INVENTION

The present invention relates to an apparatus for reproduction of sound, where transmission of sound from the apparatus is able to be varied, and a corresponding method of varying transmission of sound from the sound reproduction apparatus.

BACKGROUND

In an age when multimedia devices are commonplace, it is inevitable that speaker systems are ubiquitous as broadcasting sound output to a particular region of space would be a likely endeavour. There are many types of speaker systems which are commonly available, such as, for example, multiple satellite speaker systems with a subwoofer, multiple satellite speaker systems without a subwoofer, multiple standalone speakers in various shapes/sizes, and so forth.

Currently, speakers may be physically positioned to affect how sound is transmitted from the speakers to a user. Similarly, an orientation of the speakers may also be varied to affect how sound is transmitted from the speakers to the user. However, the speakers are all in the form of separate units and may be difficult to arrange in a manner desired by the user due to location constraints where the speakers are deployed. Furthermore, the speakers in the form of separate units do not couple with each other, and forming a single speaker unit from the separate units may be done using securing mechanisms, for example, adhesives, cable ties, screws, rivets and so forth. Unfortunately, use of the aforementioned securing mechanisms typically either damage the separate units or are detrimental to the appearance of the separate units. This is undesirable.

In addition, an increasing popularity of flat screen display devices has led to the increasing popularity of the sound bar type of speaker system which visually matches the appearance of flat screen display devices. It should be noted that the sound bar type of speaker system does not allow variation in relation to how sound is transmitted. In this regard, the sound is transmitted from the sound bar type of speaker system in a manner dependent on how a sound driver(s) is positioned within a casing of the sound bar type speaker system. Thus, variation of how sound is transmitted is not possible since the sound driver(s) is not able to be re-positioned within the casing. This lack of adjustment is also undesirable.

SUMMARY

In a first aspect, there is provided an apparatus for sound reproduction which is able to vary transmission of sound. The apparatus includes a plurality of speaker casings, with each of the plurality of speaker casings including at least one speaker driver; and a plurality of bases for each of the plurality of speaker casings, with a top portion of each base being for securable placement of a foot of one of the plurality of speaker casings, and a bottom face of each base being for securable attachment to the bottom face of another of the plurality of bases. In a first configuration of the apparatus, the plurality of speaker casings is securely placed on the top portion of each of the plurality of bases, and independently rests on the bottom face of each base. In a second configuration of the apparatus, the plurality of speaker casings is securely placed on the top portion of each of the plurality of bases, and is attached to one another at the bottom face of each base.

It is preferable that the top portion of each base and the foot of one of the plurality of speaker casings are able to couple with one another. It is advantageous that coupling the foot of one of the plurality of speaker casings to the top portion of each base enables motion of the speaker casing about the base, the motion being, for example, all round swivel, side-to-side, front-to-rear and so forth. It is advantageous that motion of the speaker casing about the base enables variation of sound transmission.

The bottom face of each base may be securably attachable to one another using either adhesives or a securing mechanism.

Each of the plurality of speaker casings and each of the plurality of bases may have respective regions of either identical or different cross-sectional shapes such as, for example, elliptical, circular, polygonal, any combination of the aforementioned and so forth. It is preferable that when each of the plurality of speaker casings and each of the plurality of bases have respective regions of identical cross-sectional areas and a circular cross-sectional shape, a stand is used in the second configuration to prevent rolling of the apparatus for sound reproduction. The stand may advantageously allow positioning of the apparatus for sound reproduction at a variety of either heights or vertical facings.

When each of the plurality of speaker casings and each of the plurality of bases have respective regions of identical cross-sectional areas and a polygonal cross-sectional shape, flat surfaces of each of the plurality of speaker casings and each of the plurality of bases may allow positioning of the apparatus for sound reproduction at a variety of vertical facings.

In a second aspect, there is provided a method for varying transmission of sound from a sound reproduction apparatus. The method includes joining two separate independent speakers at a base region of each of the speakers; and adjusting a facing of each of the two separate independent speakers. Advantageously, adjusting the facing enables variation of sound transmission from the sound reproduction apparatus. The facing of each of the two separate independent speakers may adjusted either vertically or horizontally.

It is preferable that the base of each of the speakers enables motion of a speaker casing of the speaker about the base, the motion being, for example, all round swivel, side-to-side, front-to-rear and so forth.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

Figure 1:
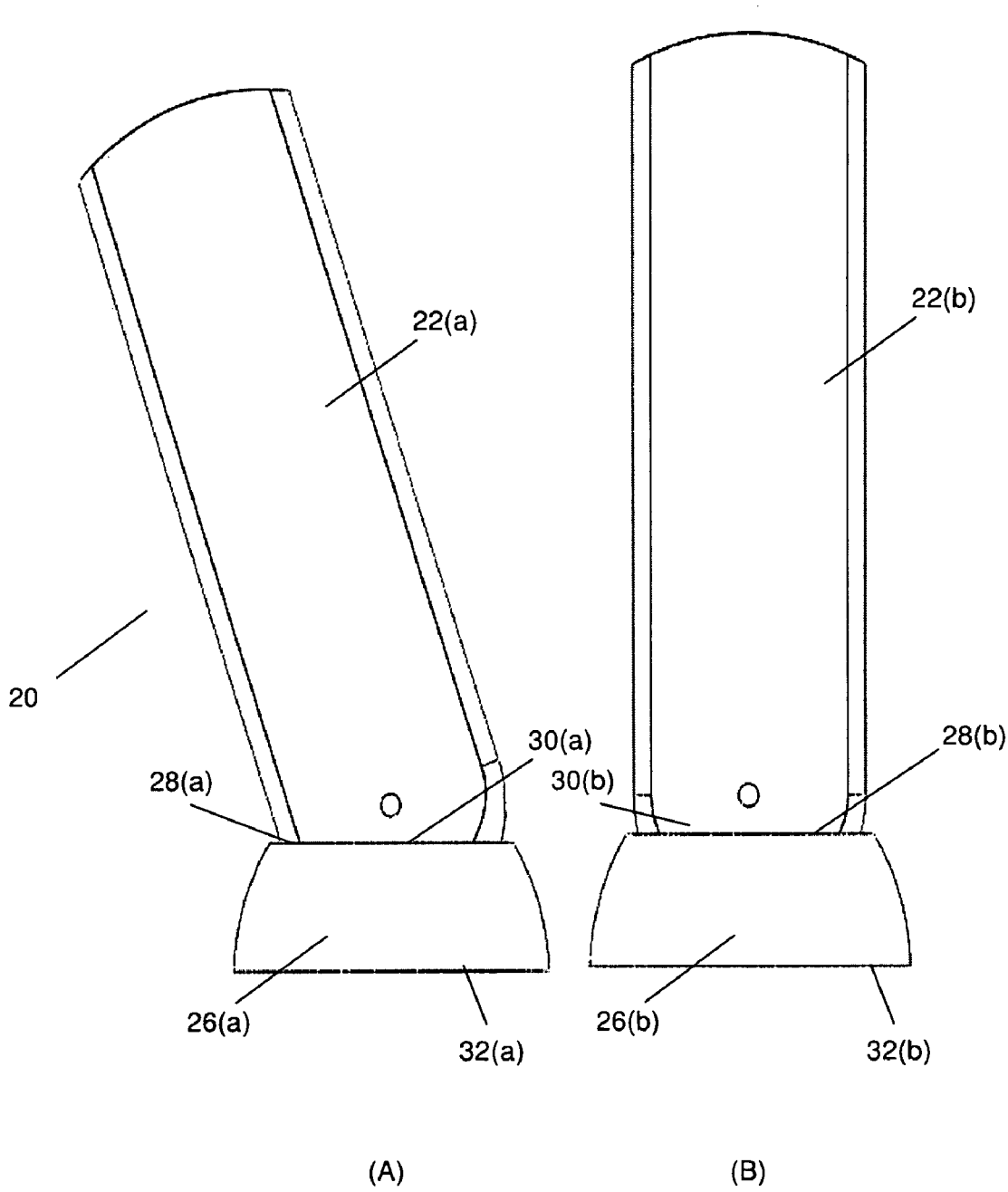
FIG. 1 shows a side view of a first embodiment of the apparatus in a first configuration.
Figure 2:
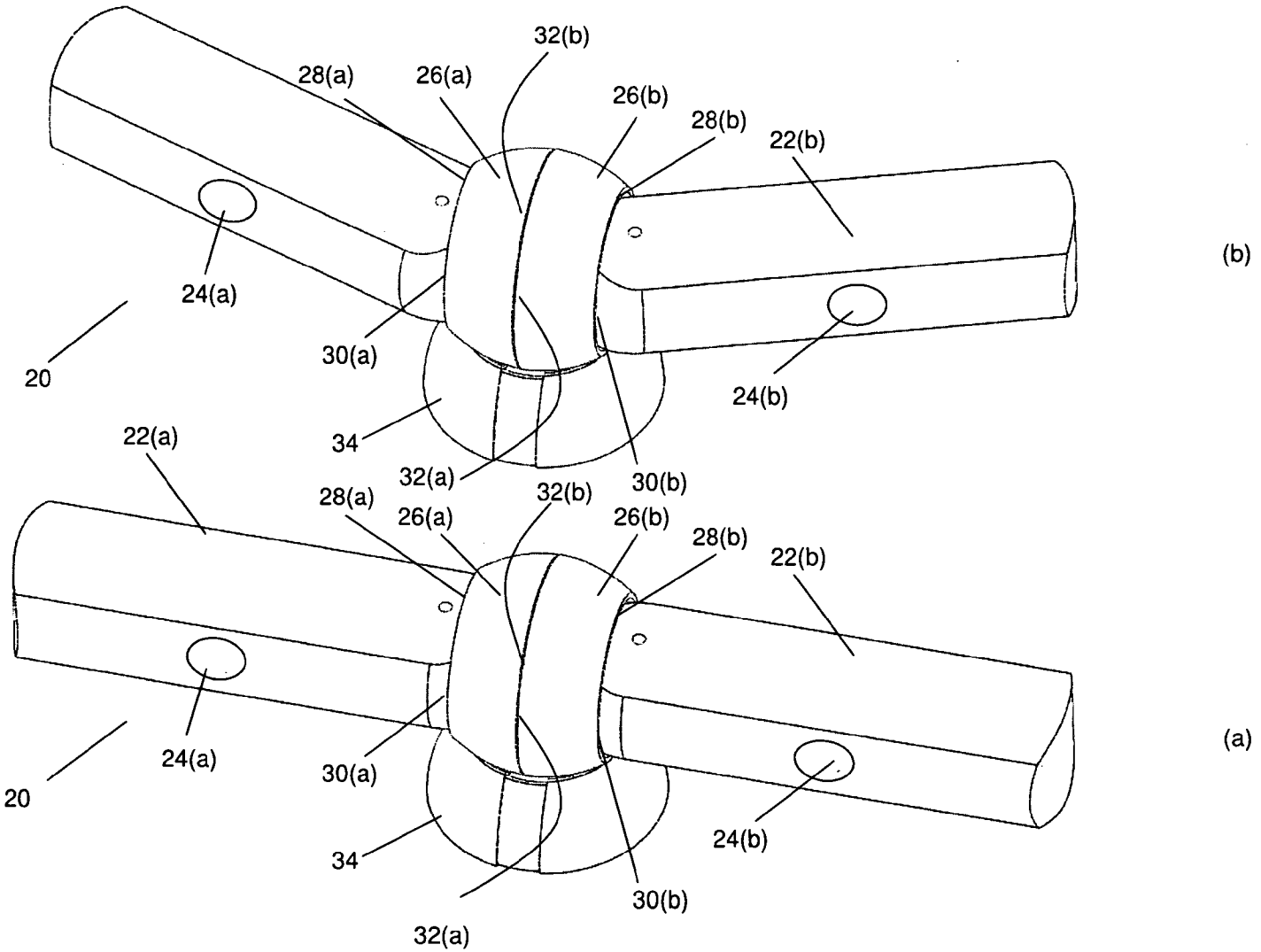
FIG. 2 shows a perspective view of the first embodiment of the apparatus in a second configuration.

Referring to FIGS. 1 and 2, there is shown a first embodiment of an apparatus for sound reproduction 20. It is advantageous that the apparatus for sound reproduction 20 is able to vary transmission of sound. FIG. 1 shows the first embodiment of the apparatus for sound reproduction 20 when in a first configuration, while FIG. 2 shows the first embodiment of the apparatus for sound reproduction 20 when in a second configuration. The differences in the first configuration and the second configuration of FIGS. 1 and 2 respectively will be evident from the description provided in the subsequent paragraphs.

The apparatus for sound reproduction 20 includes a plurality of speaker casings 22(*a*), 22(*b*), with each of the plurality of speaker casings 22(*a*), 22(*b*) including at least one speaker driver 24(*a*), 24(*b*) respectively. It should be appreciated that the at least one speaker driver 24(*a*), 24(*b*) in each of the plurality of speaker casings 22(*a*), 22(*b*) is able to function in a manner to generate sound output when the at least one speaker driver 24(*a*), 24(*b*) receives the requisite electrical signals. It may be preferable that the speaker casings 22(*a*), 22(*b*) are of identical shape and form, such that the apparatus for sound reproduction 20 has a symmetrical appearance. It can be seen from FIGS. 1 and 2 that the first embodiment of the apparatus for sound reproduction 20 includes two speaker casings 22(*a*), 22(*b*).

The apparatus for sound reproduction 20 may also include a plurality of bases 26(*a*), 26(*b*) for each of the plurality of speaker casings 22(*a*), 22(*b*). A top portion 28(*a*), 28(*b*) of each base 26(*a*), 26(*b*) respectively may be for securable placement of a foot 30(*a*), 30(*b*) of speaker casings 22(*a*), 22(*b*) respectively. FIG. 1 shows the feet 30(*a*), 30(*b*) of the speaker casings 22(*a*), 22(*b*) being securely placed at the top portions 28(*a*), 28(*b*) of the bases 26(*a*), 26(*b*). The top portion 28(*a*), 28(*b*) of each base 26(*a*), 26(*b*) and the feet 30(*a*), 30(*b*) of the speaker casings 22(*a*), 22(*b*) may be able to couple with one another. The coupling of the feet 30(*a*), 30(*b*) of the speaker casings 22(*a*), 22(*b*) to the top portion 28(*a*), 28(*b*) of each base 26(*a*), 26(*b*) enables motion of the speaker casing 22 about the base, with the motion being, for example, all round swivel, side-to-side, front-to-rear and the like.

In the first configuration from a side view of the first embodiment of the apparatus for sound reproduction 20 as shown in FIG. 1, the feet 30(*a*), 30(*b*) of each of the speaker casing 22(*a*), 22(*b*) is coupled to the top portion 28(*a*), 28(*b*) of each base 26(*a*), 26(*b*). FIG. 1(A) shows the speaker casing 22(*a*) being tilted in a front-to-rear manner. Thus, it can be appreciated that moving the speaker casing 22(*a*) from front-to-rear enables a change in the transmission of sound from the speaker casing 22(*a*) as the speaker casing 22(*a*) is tilted in a front-to-rear manner. It should be appreciated that while front-to-rear motion is shown in FIG. 1(A), other forms of motion of the speaker casing 22(*a*) such as, for example, all round swivel, side-to-side motion, and so forth may also enable the change in the transmission of sound from the speaker casing 22(*a*). It should also be noted that the speaker casing 22(*b*) as shown in FIG. 1(B) may also undergo motion, although this is not shown in FIG. 1(B).

A bottom face 32(*a*), 32(*b*) of each base 26(*a*), 26(*b*) may be for securable attachment to the bottom face 32(*a*), 32(*b*) of another base. The bottom face 32(*a*), 32(*b*) of each base 26(*a*), 26(*b*) is securably attachable to one another using either adhesives or a securing mechanism. The securing mechanism may include, for example, coupling pins, snap-fit assemblies, and so forth. It is preferable that the securing mechanism does not affect a stability of each base 26(*a*), 26(*b*), especially when the speaker casing 22(*a*), 22(*b*) is coupled to the top portion 28(*a*), 28(*b*) of each base 26(*a*), 26(*b*). When the bottom face 32(*a*), 32(*b*) of each base 26(*a*), 26(*b*) is securably attachable to one another, the apparatus for sound reproduction 20 may be in a second configuration as shown in FIG. 2. It should be noted that the second configuration of the apparatus for sound reproduction 20 is similar to a "sound bar" type of speaker as the apparatus for sound reproduction 20 is in a substantially horizontal orientation.

Referring to FIG. 2, when the bottom face 32(*a*), 32(*b*) of each base 26(*a*), 26(*b*) is securably attachable to one another, the speaker casing 22(*a*), 22(*b*) may still undergo motion about the respective base 26(*a*), 26(*b*), with the motion being, for example, all round swivel, side-to-side, front-to-rear and the like. An example of the aforementioned motion is shown in FIG. 2(*b*). It should be noted that the motion of the speaker casings 22(*a*), 22(*b*) may also enable change in the transmission of sound from the apparatus for sound reproduction 20. When the apparatus for sound reproduction 20 is arranged in a first manner as shown in FIG. 2(*a*), it is evident that the transmission of sound will differ when the apparatus for sound reproduction 20 is arranged in a second manner as shown in FIG. 2(*b*) as the speaker drivers 24(*a*), 24(*b*) point in different directions.

Figure 3:
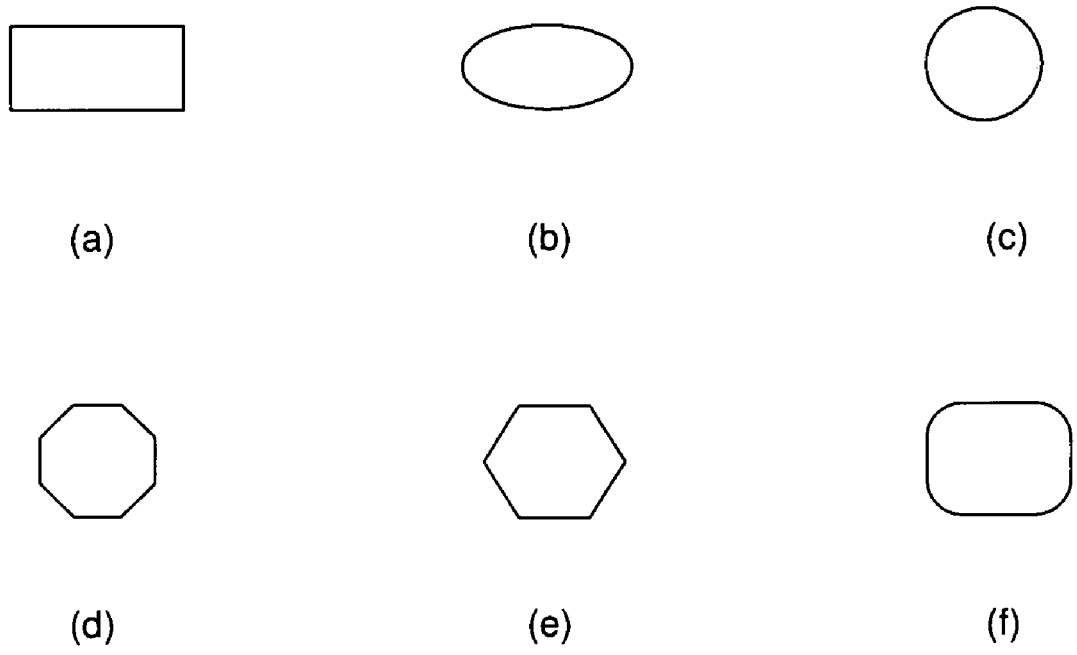
FIG. 3 shows cross-sectional shapes of regions of either a speaker casing or a base.

The speaker casings 22(*a*), 22(*b*) and the bases 26(*a*), 26(*b*) may have either identical or different cross-sectional areas. FIG. 2 shows the bases 26(*a*), 26(*b*) with regions of larger cross-sectional areas compared to the cross-sectional area of the speaker casings 22(*a*), 22(*b*). While a cross-sectional shape of the speaker casings 22(*a*), 22(*b*) is shown to be substantially uniform in FIGS. 1 and 2, this is not a mandatory requirement for the speaker casings 22(*a*), 22(*b*). The speaker casings 22(*a*), 22(*b*) may be of a form with both non-uniform cross-sectional shape and non-uniform cross-sectional area. This is because of aesthetic considerations which may affect an appearance of the speaker casings 22(*a*), 22(*b*), and consequently, an appearance of the apparatus for sound reproduction 20. With reference to FIG. 3, it should be appreciated that regions of both the speaker casings 22(*a*), 22(*b*) and the bases 26(*a*), 26(*b*) may have respective regions of cross-sectional shapes selected from, for example, elliptical (FIG. 3(*b*)), circular (FIG. 3(*c*)), polygonal (FIGS. 3(*a*), 3(*d*), 3(*e*)) and any combination of the aforementioned (FIG. 3(*f*)).

Referring to FIG. 2, it should be noted that when the bases 26(*a*), 26(*b*) have regions of larger cross-sectional areas compared to the speaker casings 22(*a*), 22(*b*), a stand 34 may be used to support the apparatus for sound reproduction 20 when the speaker casing 22(*a*), 22(*b*) coupled to the top portion 28(*a*), 28(*b*) of each base 26(*a*), 26(*b*) is securably attached to one another at the bottom face 32(*a*), 32(*b*) of each base 26(*a*), 26(*b*). The stand 34 as shown in FIG. 2 allows placement of the secured bases 26(*a*), 26(*b*) when the apparatus for sound reproduction 20 is supported by the stand 34. It should be noted that more than one stand 34 may be used at any particular instance, and the stand 34 may not only be for placement of the secured bases 26(*a*), 26(*b*) when the apparatus for sound reproduction 20 is supported by the stand 34. The stand 34 may allow positioning of the apparatus for sound reproduction 20 at a variety of either heights or vertical facings. This is because the stand 34 may have a height adjustability capability and at least one feature which enables the vertical facing of the apparatus for sound reproduction 20 to be varied. The at least one feature may be at a surface of contact between the apparatus for sound reproduction 20 and stand 34, where the surface of contact may either have a high coefficient of friction or stepped surfacing (assuming the apparatus for sound reproduction 20 has a corresponding stepped surface) to maintain different vertical facings of the apparatus for sound reproduction 20.

Figure 4:
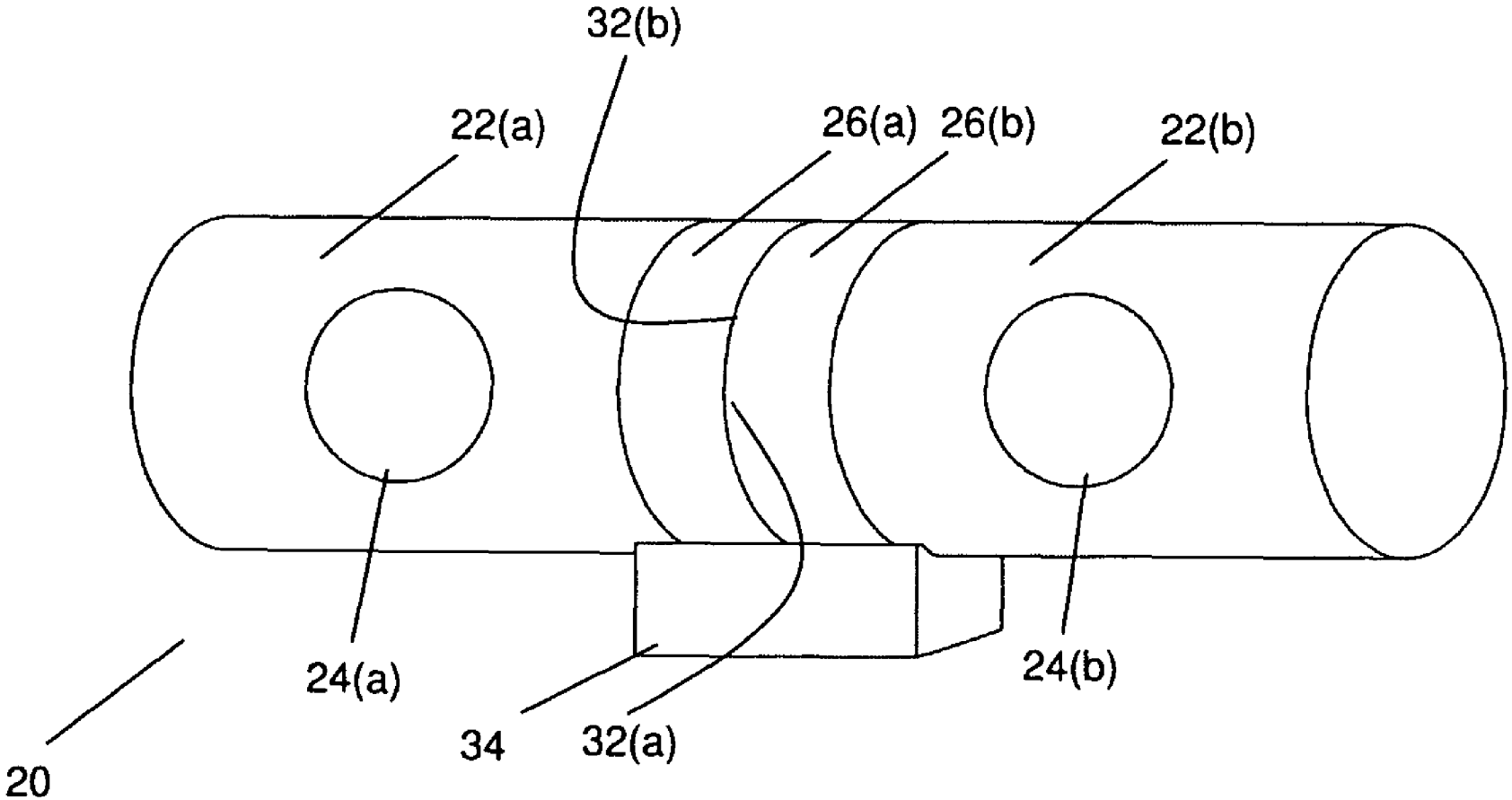
FIG. 4 shows a perspective view of a second embodiment of the apparatus in the second configuration.

Referring to FIG. 4, there is shown a second embodiment of an apparatus for sound reproduction 20 in the second configuration. In the second embodiment as shown in FIG. 4, it should be noted that the speaker casings 22(*a*), 22(*b*) and their respective bases 26(*a*), 26(*b*) have identical cross-sectional areas and a circular cross-sectional shape. In such an instance, the apparatus for sound reproduction 20 takes the form of a substantially cylindrical object. It should be appreciated that the speaker casing 22(*a*), 22(*b*) may still undergo motion about the respective base 26(*a*), 26(*b*), with the motion being, for example, all round swivel, side-to-side, front-to-rear and the like. It should be noted that the motion of the speaker casings 22(*a*), 22(*b*) may also enable change in the transmission of sound from the apparatus for sound reproduction 20.

However, when the apparatus for sound reproduction 20 takes the form of a substantially cylindrical object, the stand 34 may be used in the second configuration to prevent rolling of the apparatus for sound reproduction 20. The apparatus for sound reproduction 20 may be placed on the stand 34 during use. It is preferable that the stand 34 matches the apparatus for sound reproduction 20 in relation to appearance.

Figure 5:
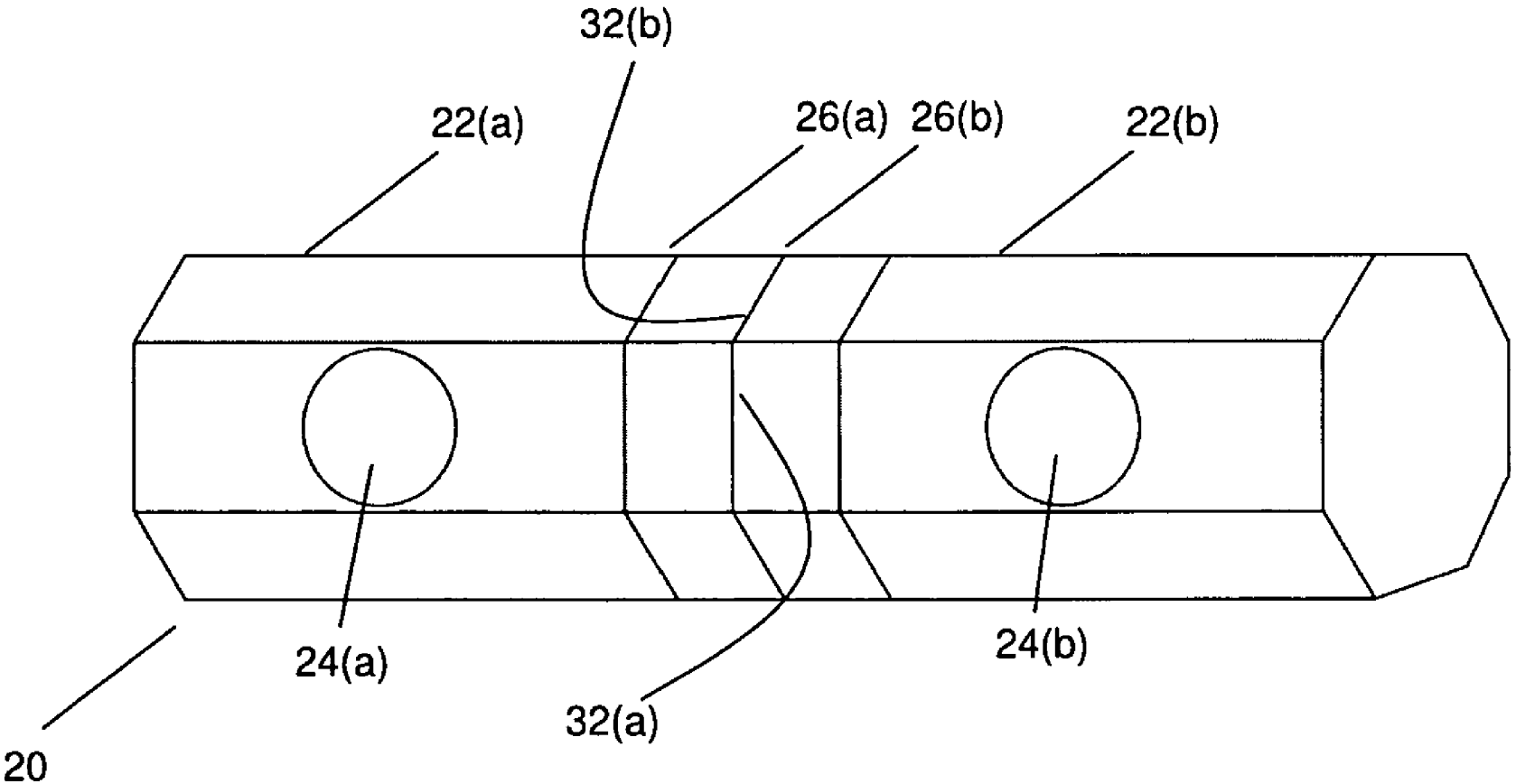
FIG. 5 shows a perspective view of a third embodiment of the apparatus in the second configuration.

Referring to FIG. 5, there is shown a third embodiment of an apparatus for sound reproduction 20 in the second configuration. In the third embodiment as shown in FIG. 5, it should be noted that the speaker casings 22(*a*), 22(*b*) and their respective bases 26(*a*), 26(*b*) have identical cross-sectional areas and an identical polygonal cross-sectional shape. The polygonal cross-sectional shape as shown in FIG. 5 is an octagon. It should be noted that the speaker casings 22(*a*), 22(*b*) may have other polygonal cross-sectional shapes other than octagonal. In such an instance, the apparatus for sound reproduction 20 may have flat surfaces (of each of the speaker casings 22(*a*), 22(*b*) and each of the bases 26(*a*), 26(*b*)) which allow positioning of the apparatus for sound reproduction 20 at a variety of vertical facings. It should be appreciated that the speaker casing 22(*a*), 22(*b*) may still undergo motion about the respective base 26(*a*), 26(*b*), with the motion being, for example, all round swivel, side-to-side, front-to-rear and the like. It should be noted that the motion of the speaker casings 22(*a*), 22(*b*) may also enable change in the transmission of sound from the apparatus for sound reproduction 20.

When the apparatus for sound reproduction 20 has a substantially polygonal cross-sectional shape, usage of a stand may be unnecessary as the flat surfaces (of each of the speaker casings 22(*a*), 22(*b*) and each of the bases 26(*a*), 26(*b*)) ensure that the apparatus for sound reproduction 20 has a resting surface that allows stable placement of the apparatus for sound reproduction 20 on any flat surface.

Figure 6:
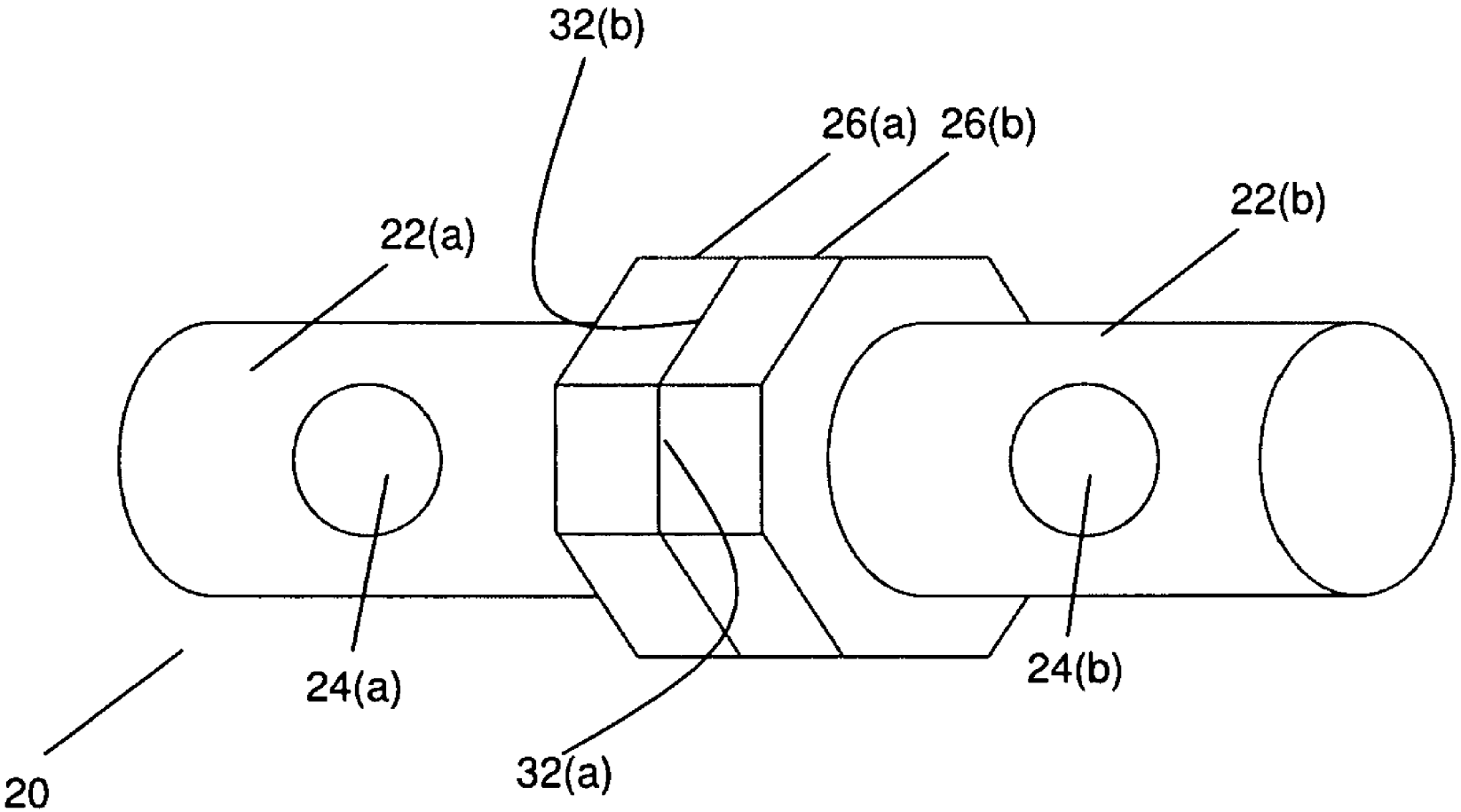
FIG. 6 shows a perspective view of a fourth embodiment of the apparatus in the second configuration.

Referring to FIG. 6, there is shown a fourth embodiment of an apparatus for sound reproduction 20 in the second configuration. In the fourth embodiment as shown in FIG. 6, it should be noted that the speaker casings 22(*a*), 22(*b*) and their respective bases 26(*a*), 26(*b*) have different cross-sectional areas and different cross-sectional shapes. In the fourth embodiment, the cross-sectional area of the bases 26(*a*), 26(*b*) is greater than the cross-sectional area of the speaker casings 22(*a*), 22(*b*). The cross-sectional shape of the bases 26(*a*), 26(*b*) is shown to be polygonal (octagonal), while the cross-sectional shape of the speaker casings 22(*a*), 22(*b*) is shown to be circular. In such an instance, the apparatus for sound reproduction 20 may have flat surfaces (of each of the bases 26(*a*), 26(*b*)) which allow positioning of the apparatus for sound reproduction 20 at a variety of vertical facings. It should be appreciated that the speaker casing 22(*a*), 22(*b*) may still undergo motion about the respective base 26(*a*), 26(*b*), with the motion being, for example, all round swivel, side-to-side, front-to-rear and the like. It should be noted that the motion of the speaker casings 22(*a*), 22(*b*) may also enable change in the transmission of sound from the apparatus for sound reproduction 20.

Usage of a stand for the fourth embodiment of the apparatus for sound reproduction 20 may be unnecessary as the flat surfaces (of each of the bases 26(*a*), 26(*b*)) ensure that the apparatus for sound reproduction 20 has a resting surface that allows stable placement of the apparatus for sound reproduction 20 on any flat surface.

Figure 7:
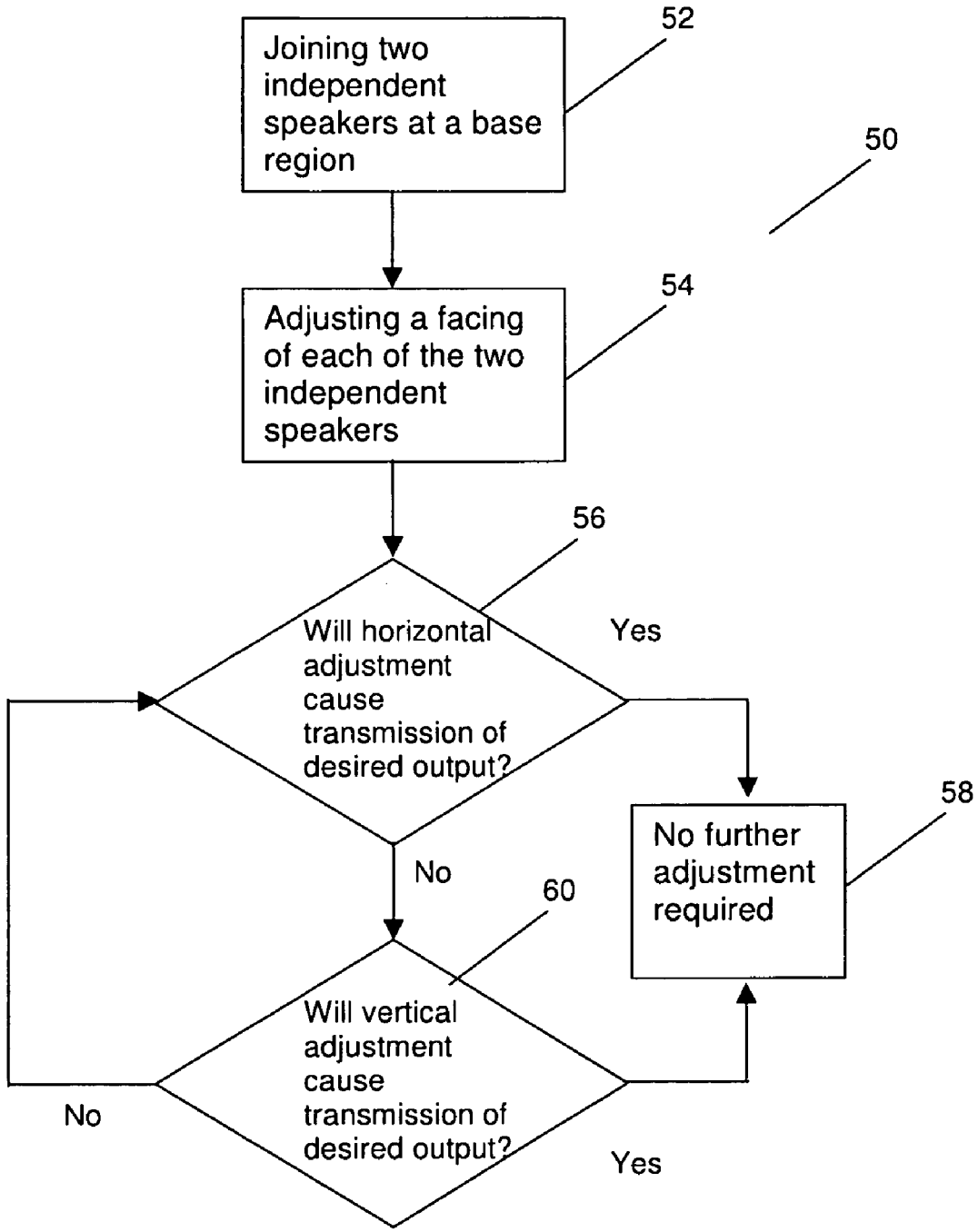
FIG. 7 shows a process flow of a preferred embodiment of a method.

Referring to FIG. 7, there is shown another aspect of the present invention. There is provided a method 50 for varying transmission of sound from a sound reproduction apparatus. It should be noted that the sound reproduction apparatus may be either similar or identical to the sound reproduction apparatus 20 mentioned in the preceding paragraphs.

The method 50 includes joining two separate independent speakers at a base region of each of the speakers (52). The two separate independent speakers may be standalone speakers which may be used either in an upright or horizontal manner. The two separate speakers may be joined at the base region using either adhesives or a securing mechanism. The securing mechanism may include, for example, coupling pins, snap-fit assemblies, and so forth. It is preferable that the securing mechanism does not affect a stability of the speakers when the speakers are used in a standalone manner.

The method 50 also includes adjusting a facing of each of the two separate independent speakers (54). It should be appreciated that adjusting the facing of each of the two separate speakers may enable variation of sound transmission from the sound reproduction apparatus. Each of the two separate independent speakers may be adjusted with motion with respect to their respective base regions, such as, for example, all round swivel, side-to-side, front-to-rear and the like. The aforementioned motion may be enabled by the base of each of the speakers.

In the method 50, it is determined whether horizontal adjustment of the separate independent speakers causes transmission of a desired sound output (56). If the desired sound output is transmitted, no further adjustment of the separate independent speakers is required (58). It should be appreciated that the desired sound output may vary from person to person since it may be a subjective parameter.

If the desired sound output is not transmitted, it is subsequently determined whether vertical adjustment of the separate independent speakers causes transmission of the desired sound output (60). If the desired sound output is transmitted, no further adjustment of the separate independent speakers is required (58). It should be appreciated that the horizontal (56) and vertical (60) adjustment of the separate independent speakers may be performed in an opposite order, that is, performing vertical (60) adjustment of the separate independent speakers before performing horizontal (56) adjustment of the separate independent speakers.

Whilst there has been described in the foregoing description preferred embodiments of the present invention, it will be understood by those skilled in the technology concerned that many variations or modifications in details of design or construction may be made without departing from the present invention.

What is claimed is:

1. An apparatus for sound reproduction which is able to vary transmission of sound, the apparatus including:

a plurality of speaker casings, with each of the plurality of speaker casings including at least one speaker driver; and a plurality of bases for each of the plurality of speaker casings, with a top portion of each base being for securable placement of a foot of one of the plurality of speaker casings, and a bottom face of each base being for securable attachment to the bottom face of another of the plurality of bases;

wherein in a first configuration, the plurality of speaker casings securely placed on the top portion of each of the plurality of bases, independently rests on the bottom face of each base, while in a second configuration, the plurality of speaker casings securely placed on the top portion of each of the plurality of bases, is attached to one another at the bottom face of each base.

2. The apparatus of claim 1, wherein the top portion of each base and the foot of one of the plurality of speaker casings are able to couple with one another.

3. The apparatus of claim 2, wherein coupling the foot of one of the plurality of speaker casings to the top portion of each base enables motion of the speaker casing about the base, the motion being selected from a group comprising: all round swivel, side-to-side and front-to-rear.

4. The apparatus of claim 1, wherein the bottom face of each base is securably attachable to one another using either adhesives or a securing mechanism.

5. The apparatus of claim 1, wherein each of the plurality of speaker casings and each of the plurality of bases have respective regions of different cross-sectional shapes.

6. The apparatus of claim 1, wherein each of the plurality of speaker casings and each of the plurality of bases have respective regions of identical cross-sectional areas.

7. The apparatus of claim 6, wherein when each of the cross-sectional areas is a circular cross-sectional shape, a stand is used in the second configuration to prevent rolling of the apparatus for sound reproduction, and wherein the stand allows positioning of the apparatus for sound reproduction at a variety of either heights or vertical facings.

8. The apparatus of claim 6, wherein when each of the cross-sectional areas is a polygonal cross-sectional shape, flat surfaces of each of the plurality of speaker casings and each of the plurality of bases allow positioning of the apparatus for sound reproduction at a variety of vertical facings.

9. The apparatus of claim 3, wherein motion of the speaker casing about the base enables variation of sound transmission.

* * * * *